US007926541B2

(12) United States Patent
Chou

(10) Patent No.: US 7,926,541 B2
(45) **Date of Patent: *Apr. 19, 2011**

(54) UNIVERSAL POLYGONAL TILT DRUM FOR VENETIAN TYPE BLINDS

(76) Inventor: Tser Wen Chou, Yorba Linda, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/406,811

(22) Filed: Mar. 18, 2009

(65) Prior Publication Data

US 2010/0236726 A1 Sep. 23, 2010

(51) Int. Cl.
*E06B 9/307* (2006.01)

(52) U.S. Cl. ..... 160/177 R; 160/176.1 R; 160/178.1 R

(58) Field of Classification Search ..... 160/176.1 R, 160/177 R, 178.3, 178.1 R, DIG. 15; 242/587.2
See application file for complete search history.

(56) References Cited

U.S. PATENT DOCUMENTS

| | | | | |
|---|---|---|---|---|
| 2,396,425 | A * | 3/1946 | Hunter | 160/177 R |
| 2,469,839 | A * | 5/1949 | Nelson | 160/177 R |
| 2,760,733 | A * | 8/1956 | Harris et al. | 242/587.2 |
| 3,333,905 | A * | 8/1967 | Hennequin | 384/440 |
| 5,573,052 | A * | 11/1996 | Liu | 160/177 R |
| 6,279,642 | B1 * | 8/2001 | Liu | 160/177 R |
| 6,527,034 | B1 * | 3/2003 | Liu | 160/177 R |
| 6,622,770 | B1 * | 9/2003 | Tyner | 160/178.1 R |
| 7,258,297 | B2 * | 8/2007 | Liu | 242/398 |
| 7,665,503 | B2 * | 2/2010 | Liu | 160/176.1 R |
| 2003/0041979 | A1 * | 3/2003 | Liu | 160/177 R |
| 2005/0145346 | A1 * | 7/2005 | Chen | 160/178.1 R |
| 2007/0181266 | A1 * | 8/2007 | Wen et al. | 160/177 R |
| 2007/0204964 | A1 * | 9/2007 | Damiano | 160/177 R |
| 2008/0083513 | A1 * | 4/2008 | Chen | 160/177 R |
| 2008/0099161 | A1 * | 5/2008 | Liu | 160/177 R |
| 2010/0084099 | A1 * | 4/2010 | Chou | 160/170 |
| 2010/0236726 | A1 * | 9/2010 | Chou | 160/133 |

* cited by examiner

*Primary Examiner* — Blair M. Johnson
(74) *Attorney, Agent, or Firm* — Ming Chow; Sinorica, LLC

(57) ABSTRACT

A ladder drum for adjusting and regulating the angular orientation and closure of horizontal slats of a venetian blind, of the type incorporating ladder cords or tape ladders, having a polygonal profiled structure comprising a series of planar sidewalls defining a substantially hollow interior. The number of sidewalls defining the polygonal structure is greater than four sidewalls, and less than or equal to twelve sidewalls, with each adjacent plane sidewall having an internal angular orientation in the range of 90° to 150°. To enhance the uniform closure of the slats of a horizontal blind, the polygonal ladder drum is more preferably in the form of an uneven hexagon that is formed from injection molded plastics. The opposing top and bottom sidewalls are greater in dimension than the mediate sidewalls, and have attachment means to insert various widths of ladder tape. The mediate sidewalls have at least two opposing access slots to insert and retain ladder cords in a counter balanced relation.

10 Claims, 6 Drawing Sheets

UNIVERSAL POLYGONAL TILT DRUM FOR VENETIAN TYPE BLINDS

BACKGROUND OF THE INVENTION

1. Field of the Invention

The present invention relates to venetian blind components, and more specifically to adjustable tilt drums that regulate the angular adjustment of horizontal slats in a blind assembly. In particular, the invention features a polygonal tilt drum that provides for the improved closure of slats in a venetian blind, and accommodates the attachment of various kinds of ladder cords or tapes.

2. Discussion of the Prior Art

Venetian blinds have enjoyed widespread use as a decorative and functional solution for providing privacy and light control for windows. Typically, these coverings feature a sequence of horizontally oriented slats that are suspended beneath a headrail through the use of braided ladder cords or woven fabric ladder tapes. At least two ladders are required to assemble a blind, where more may be required depending on the overall width of the window covering, and the kind of slat material used within the construction. Each type of ladder includes a pair of vertically extending legs that are interconnected by a plurality of horizontal rungs spaced at regular intervals, which support and retain the slats in parallel fashion. The upper ends of each ladder are correspondingly attached to a tilt drum, which is carried on a tilt rod located within the headrail. The bi-directional rotation of the tilt rod causes the tilt drums to uniformly turn in response to the selective adjustment of the tilting mechanism. The reciprocating movement of each tilt drum will vertically raise one leg of each ladder cord or tape, while alternately lowering the corresponding leg of each ladder, thereby causing the attached rungs and slats to slant in relation to the vertical orientation of the parallel ladder legs. Accordingly, with this traditional assembly, the slats of a venetian blind may be opened, closed or adjusted to control privacy and the degree of light entering a room.

Usually, most prior art tilt mechanisms for venetian blinds utilize cylindrically shaped tilt drums, which have an attachment means for securing braided ladder cords, fabric ladder tapes, or are designed to accept the selection of either ladder style. Such pieces may be fabricated from metal stampings or, alternatively, may be formed from injection molded plastic. One of the known disadvantages of using these barrel-shaped components relates to their unfavorable effect in attaining uniform closure among the slats of a horizontal blind. This is due to the fact that when the suspended slats are adjusted into a fully closed position, the tilt mechanism winds the ladder cords or tapes around each tilt drum, thereby increasing their overall diameter. In this particular instance, the enlarged outside dimension of the tilt drum inhibits the full range of vertical motion in the uppermost segments of each ladder leg, thus limiting the effective closure of the top slat of an assembled blind. For blinds using ladder cords, this problem may be overcome through the installation of slat clips, which secures the uppermost slat into position with the first rung of a ladder cord, effectively holding the slat into position to follow the perpendicular movement of the ladder legs.

Another option for improving the closure of venetian type blinds has been disclosed by Tyner, in U.S. Pat. No. 6,622,770, wherein the profile of the tilt drum mechanism is generally elliptical or oval in shape. According to the invention, the contour of the tape drum causes the legs of the ladder to move in unison throughout the vertical length of the blind, and particularly in the region located closest to the top slat. However, the major diameter of this elliptically shaped tilt drum orients the significant weight of the suspended slats away from the central supporting axis of the tilt rod. This increases the load on the axial passage molded into the more slender region of the plastic component. Furthermore, this uneven weight displacement inhibits the smooth angular rotation of the slats as they are adjusted by the tilting mechanism.

Accordingly, it is an object of the present invention to provide a resilient tilt drum for venetian type blinds that improves the closure of suspended slats within such window coverings.

It is a further object of the invention to provide a tilt drum having a profile in the form of a polygonal structure consisting of a plurality of faceted sidewalls encompassing a central supporting tilt rod core.

It is yet another object of the invention to provide a tilt drum having inherent design features that facilitate the efficient attachment of ladder cords or, alternatively, ladder tapes of different dimensional widths.

Finally, an object of the invention is to provide a tilt drum having features that effectively counter balance the weight of suspended slats—to enhance the ease of operation—while additionally facilitating the efficient attachment of ladder cords.

These and other objects of the invention will be apparent to those skilled in the art from the following detailed description of the preferred embodiments of the instant invention.

SUMMARY OF THE INVENTION

The disadvantages and limitations of the background art discussed above are overcome by the present invention. With this invention, an improved drum component for use within venetian blind tilting mechanisms is provided, wherein a polygonal structure—preferably in the form of an uneven hexagon—encompasses a central supporting tilt rod core. The hexagonal facets of the tilt drum enhance the full range of vertical motion for the corresponding legs of ladder cords or tapes, thereby facilitating a tighter closure among the suspended slats.

In accordance with the present invention, the polygonal tilt drum comprises a series of six outer sidewalls, with each adjoining wall oriented at 120° degrees to one another, defining a hollow hexagonal body. The top and bottom walls of the profile body are equal in length, where the four remaining sidewalls are of equal dimension but somewhat shorter than the top and bottom segments. The hollow profile is segmented by a series of ribs that extend from a central tilt rod supporting core—which extends lengthwise through the tilt drum—defining a sequence of cavities designed to receive the installation of various kinds of ladder tape material. The top two cavities are accessible through the front portion of the profile, and each longitudinally define a channel that terminates at the rear closed end portion of the tilt drum. Two mediate and one bottom cavity extend through the entire length of the profile and terminate at the rear of the closed end portion of the tilt drum.

Inscribed within the top wall of the profile body are two grooves that are each located directly above the top two closed-end longitudinal channels, each opening is accessible via a tapered notch in the front portion of the tilt drum that later transforms into a sinusoidal slot extending toward the rear of the component. Each tapered notch has a singular wedge shaped tooth located at the outermost edge of each opening, and extends inwardly toward the center of the upper sidewall. Preferably, each tooth has a ramp facing the open-end portion of the top section of the body, and has a right-angled stop surface facing the closed-end portion thereof. The sinusoidal grooves also define a central projection located on the top wall of the tilt drum, extending from the rear of the tilt mechanism, and is secured underneath with a center support rib. Within each top channel—and below each groove—an elongated rod extends from the closed end portion of the tilt drum to secure the upper loops of ladder tape into position.

To facilitate the optional use of braided ladder cords, the two outer side walls defining the mediate cavities of the polygonal tilt drum are each molded with two intersecting ovular holes, the first opening greater in proportion than the second, to accommodate the attachment of the cord support legs. An enlarged tag is firmly attached to each end of each leg of the ladder cord, and to effectively counter balance the weight of the suspended slats, the tabbed end segments of the ladder legs cross over the body of the tilt drum, and each tab is then correspondingly inserted into the larger openings and are subsequently moved and secured into position behind each smaller ovular opening.

The polygonal tilt drum of the present invention advantageously includes a bottom cavity designed to additionally accommodate the use of narrower width ladder tapes in the fabrication of a venetian blind assembly. Within the front portion of the profile body, a singular tapered notch extends lengthwise toward the rear of the component, transforming into a wider slot that is large enough to retain the thickness of two woven ladder legs. The slot is defined by a series of parallel edges, where the midsection of the slot is greater in width than at its origin or terminus. To secure the ladder tape into position, a cotter key—having a set of retaining prongs—is used to fasten the loops formed at the top ends of each corresponding ladder leg; the assembly is then inserted through the tapered notch and centered at the midsection of the slot.

Further objects and advantages of the present invention will be apparent from the following description of the preferred embodiments when considered in conjunction with the accompanying drawings.

DETAILED DESCRIPTION OF THE PREFERRED EMBODIMENT

Figure 1B:
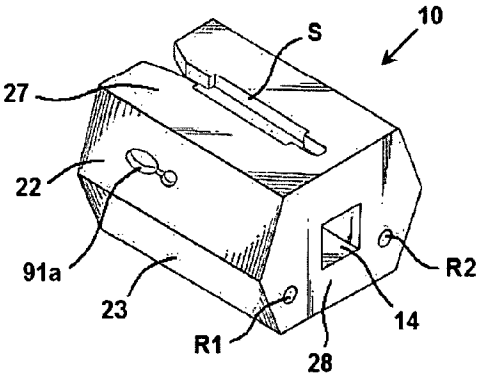
FIGS. 1*a* and 1*b* are perspective views of the top and inverted bottom surfaces of the polygonal tilt drum for a venetian blind in accordance with the present invention.
Figure 1A:
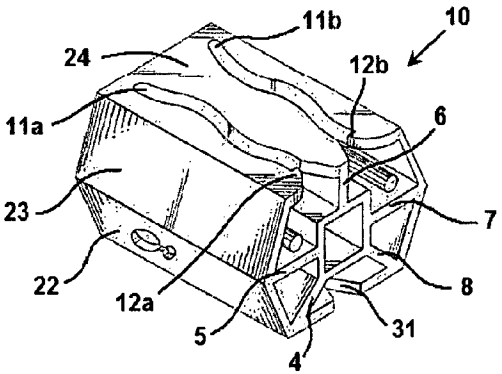
Figure 2B:
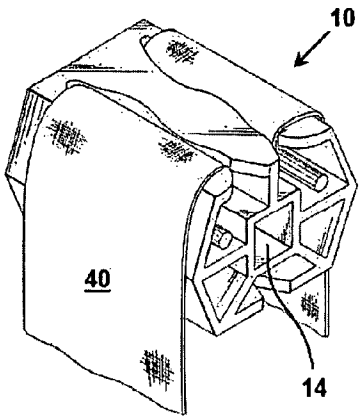
FIGS. 2*a* and 2*b* are perspective views of the polygonal tilt drum illustrating the insertion of ladder tapes into the sinusoidal shaped top grooves of the component.
Figure 2A:
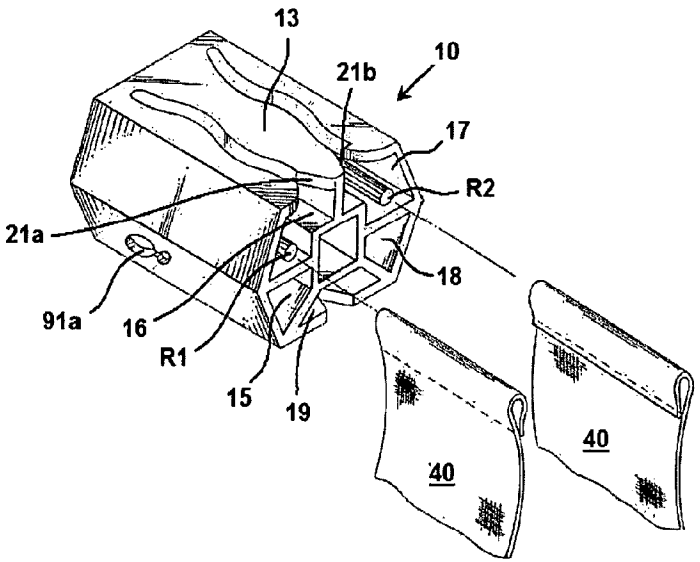

With reference to FIGS. 1*a*, 1*b*, 2*a*, and 2*b*, a polygonal tilt drum 10 for use within venetian blind tilting mechanisms is provided, wherein a series of six outer sidewalls 22, 23, 24, 25, 26, and 27, with each adjoining wall oriented at 120° degrees to one another, define a hollow hexagonal body. The top wall 24 and bottom wall 27 of the profile body are equal in length, where the four remaining sidewalls 22, 23, 25, and 26 are of equal dimension but somewhat shorter than the top and bottom segments. The hollow profile is segmented by a series of ribs 4, 5, 6, 7, and 8 that extend from the central tilt rod supporting core 14—which extends lengthwise through the tilt drum 10—defining a sequence of cavities 15, 16, 17, 18, and 19 designed to receive the installation of various kinds of ladder tape material. The two top cavities 16 and 17 are accessible through the front portion of the profile, and each longitudinally define a channel that terminates at the rear closed end portion 28 of the tilt drum 10. Two mediate cavities 15 and 18, and one bottom cavity 19, extend through the entire length of the profile and also terminate at the rear of the closed end portion 28 of the tilt drum.

Inscribed within the top wall 24 of the polygonal tilt drum 10 are two grooves 11*a* and 11*b* that are each located directly above the top two closed-end longitudinal cavities 16 and 17, each groove is accessible via a tapered notch 21*a* and 21*b*, in the from portion of the tilt drum that later transforms into the sinusoidal shaped grooves 11*a* and 11*b*. Each tapered notch 21*a* and 21*b* has a singular wedge shaped tooth 12*a* and 12*b*, located at the outermost edge of each opening, and extends inwardly toward the center of the upper sidewall 24. Preferably, each tooth has a ramp facing the open-end portion of the top section of the tilt drum 10, and has a right-angled stop surface facing the closed-end portion thereof. The sinusoidal grooves 11*a* and 11*b* also define a central projection 13 on the top wall 24 of the tilt drum, extending from the rear of the tilt mechanism, and is secured underneath with a center support rib 6. Within each top cavity 16 and 17—and below each groove 11*a* and 11*b*—elongated rods R1 and R2 extend from the closed end portion of each cavity to secure the upper loops 41*a* and 41*b* of the ladder tape 40 into position.

Figure 3C:
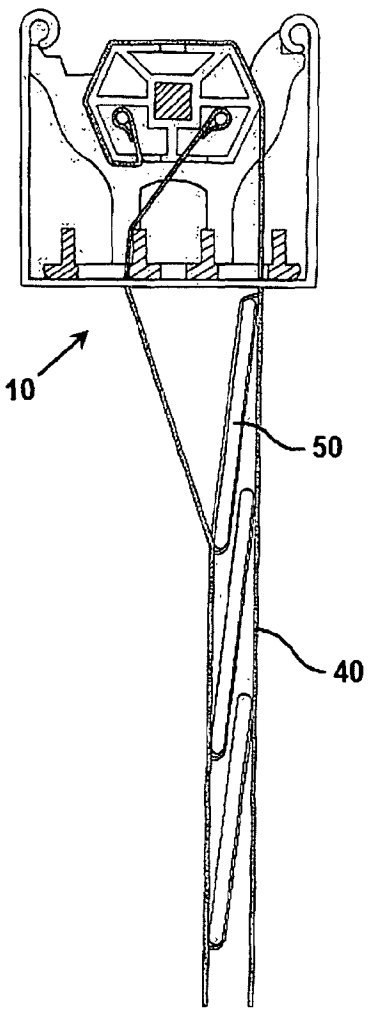
FIGS. 3*a*-3*c* are profile views of the polygonal tilt drum, illustrating the functional attachment of the ladder tapes in conjunction with the elongated rods, in progressive stages of operation.
Figure 3B:
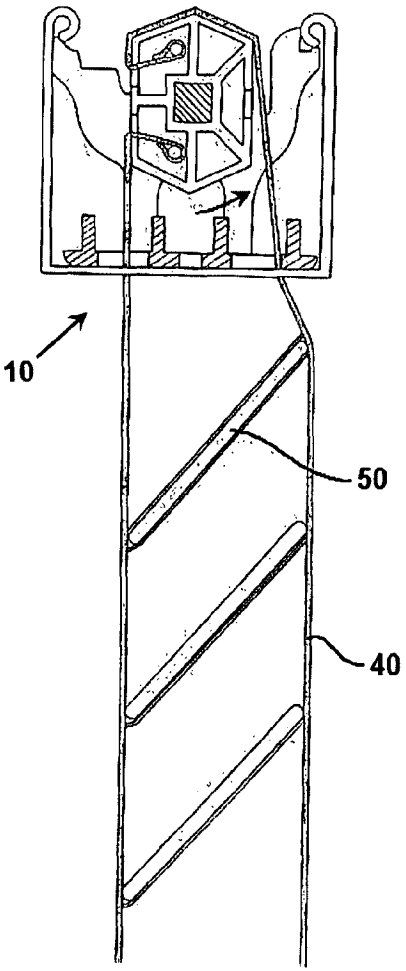
Figure 3A:
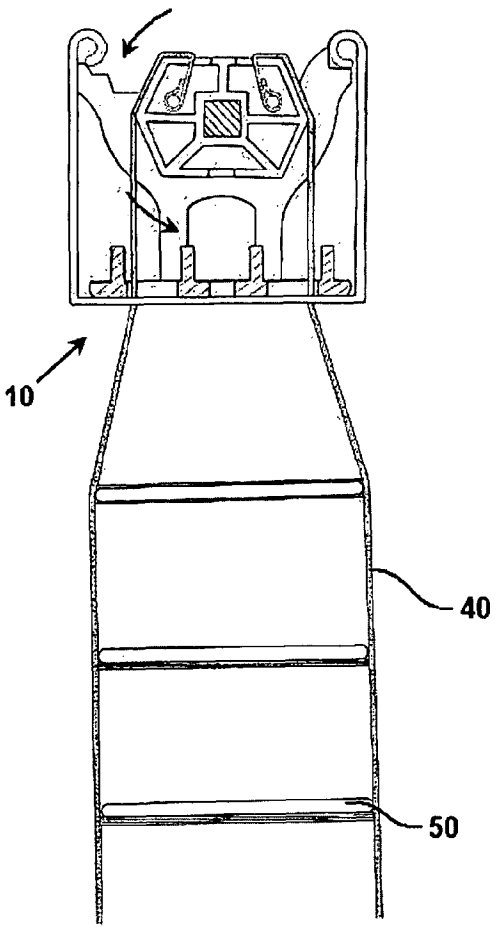

Turning now to FIGS. 3*a*-3*c*, the polygonal tilt drum 10 is illustrated in progressive stages of operation, wherein the ladder tape 40 is attached to the elongate rods R1 and R2, and the slats 50 are shown at different degrees of closure with the counterclockwise rotation of the tilt drum. It should be noted that this particular adjustment to the slats is made by way of example only, and the tilt drum may be rotated in a clockwise rotation as well. Within FIG. 3*a*, the polygonal tilt drum 10 is positioned at a 0° angle, and the slats 50 are positioned in parallel relation. As shown in FIG. 3*b* the tilt drum 10 is rotated at a 90° angle and the slats 50 are approximately tilted at a 60° angle. In FIG. 3*c* the tilt drum 10 is rotated at a 180° angle and the slats 50 are shown in a closed relation. The tight closure of the slats is achieved because the ladder tape 40 is not substantively altering the outside diameter of the tilt drum, and the rotational positioning of the elongated rods R1 and R2 allows the ladder tape 40 to completely extend from the tilt mechanism.

Figure 4A:
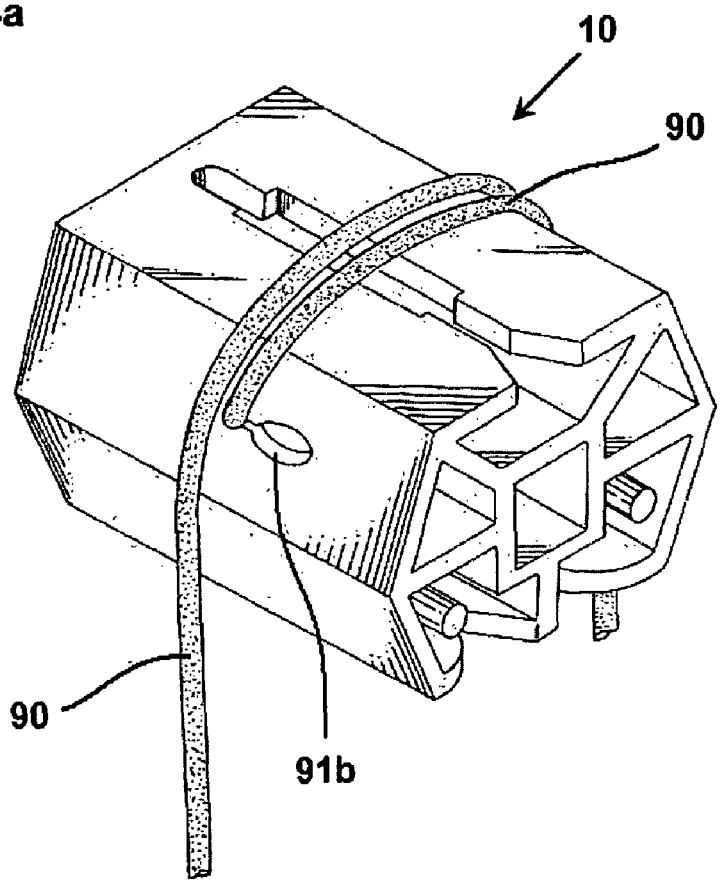
FIGS. 4*a* and 4*b* are perspective and plan views of the bottom sidewall of the polygonal tilt drum, illustrating the mediate cavity attachment of the ladder cord legs in counter balanced relation.
Figure 4B:
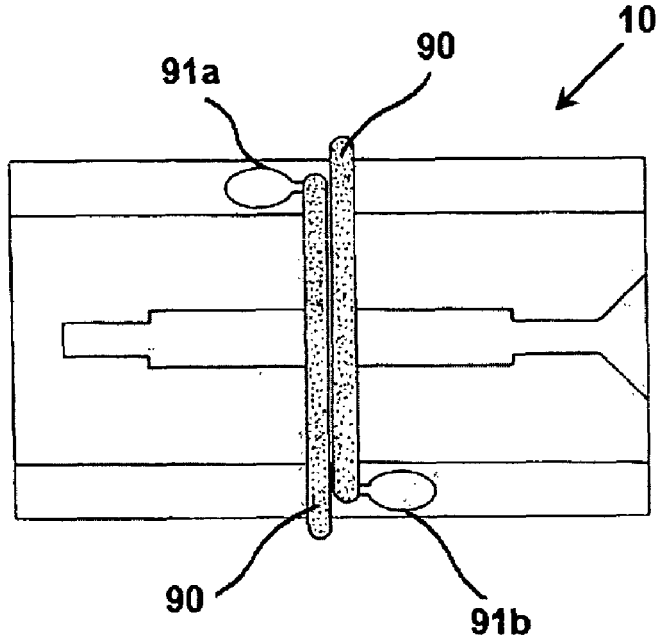

As shown in FIGS. 4*a* and 4*b*, to facilitate the optional use of braided ladder cords, the two outer side walls, 22 and 26 defining the mediate cavities 15 and 18 of polygonal tilt drum 10, are each molded with two intersecting ovular holes 91*a* and 91*b*, the first opening greater in proportion than the second, to accommodate the attachment of the cord support legs. Within a preferred embodiment of the invention, and to effectively counter balance the weight of suspended slats, the tabbed end segments (not shown) of the ladder legs 90 cross over the body of the tilt drum, and each are inserted within the opposite facing larger openings of ovular holes 91*a* and 91*b*, which are subsequently moved and secured into position behind each smaller ovular opening.

Figure 5:
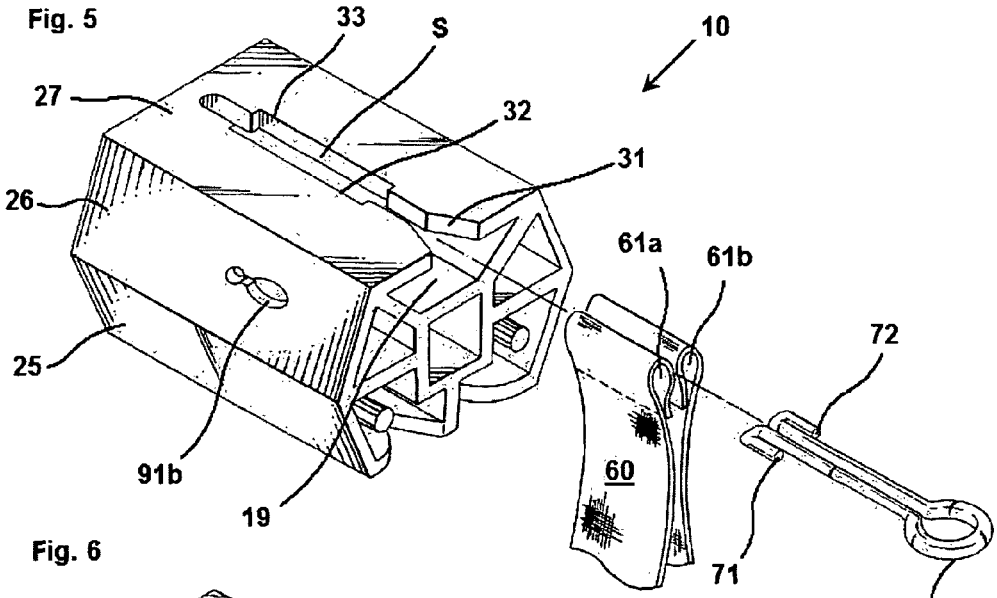
FIG. 5 is an exploded perspective view of the inverted polygonal tilt drum illustrating the assembly of ladder tapes together with a cotter pin attachment in accordance with the present invention.
Figure 6:
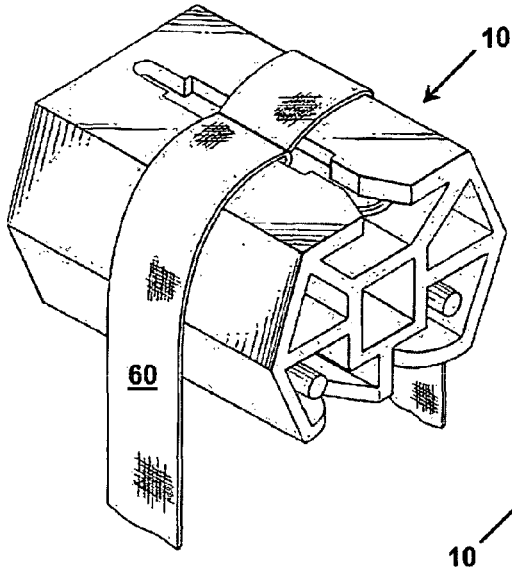
FIGS. 6 and 7 are perspective views of the polygonal tilt drum illustrating the insertion of various width ladder tape assemblies into the bottom cavity of the component.
Figure 7:
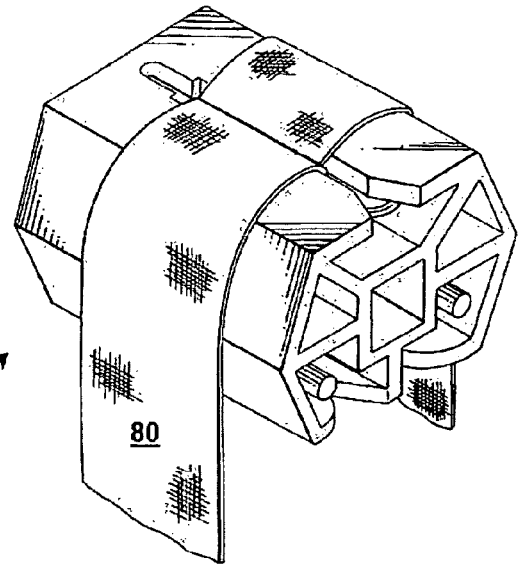

With further reference to FIG. 5, the rotated polygonal tilt drum 10 of the present invention advantageously includes a bottom cavity 19 to accommodate the use of narrower with ladder tapes in the fabrication of a venetian blind assembly. Within the front portion of the tilt drum 10, a singular tapered notch 31 extends lengthwise toward the rear of the component, transforming into a wider slot S that is large enough to retain the thickness of two woven legs of ladder tape 60 or, alternatively, ladder tape 80. The slot S is defined by a series of parallel edges, where the midsection of the slot, defined by edges 32 and 33, is greater in width than at its origin or terminus. To secure ladder tapes 60 or 80 into position, a cotter key 70—having a set of retaining prongs 71 and 72—is used to fasten the loops 61*a* and 61*b* at the top ends of each corresponding ladder leg; the assembly is then inserted through the tapered notch 31 and centered at the midsection of slot S, as illustrated in FIGS. 6 and 7.

Figure 8C:
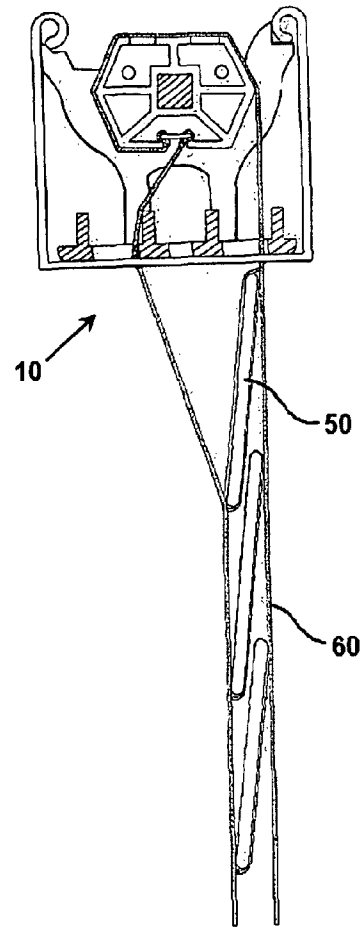
FIGS. 8*a*-8*c* are profile views of the polygonal tilt drum, illustrating the progressive stages of operation of the ladder tape and cotter pin assembly.
Figure 8B:
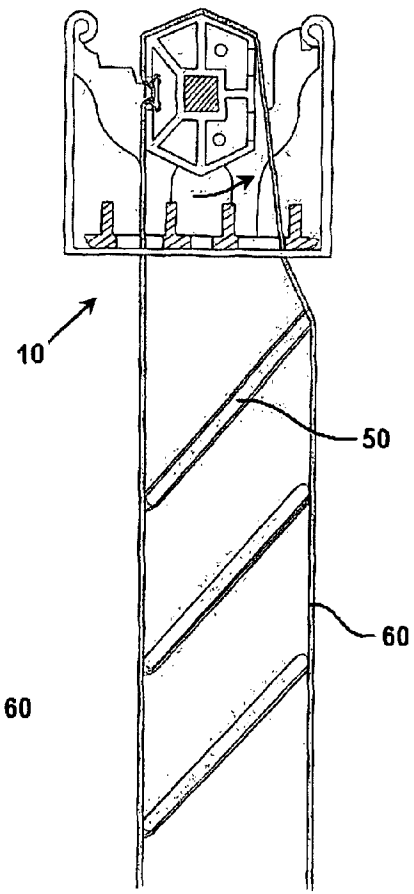
Figure 8A:
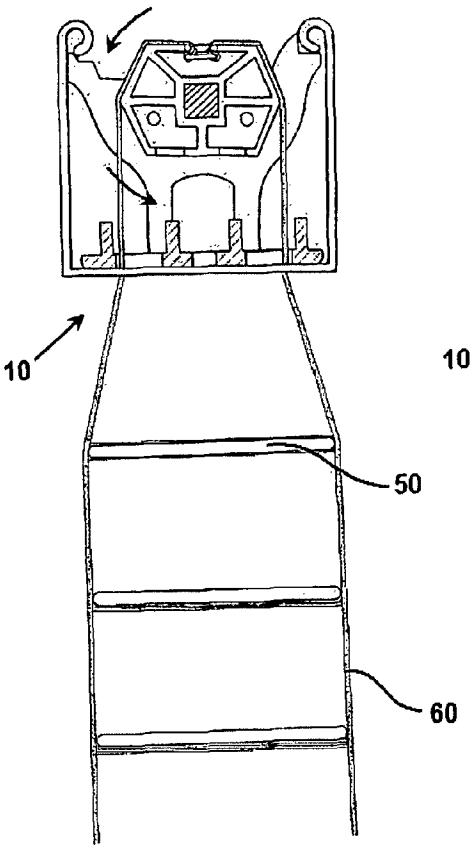

Similar to the above description concerning the mode of operation of the instant invention, the rotated polygonal tilt drum 10 is similarly shown in progressive stages of operation in FIGS. 8*a*-8*c*. In this instance, ends ladder tapes 60 or 80, of narrower widths than tape 40, are mutually attached through the use of a cotter key 70. By way of example, ladder tape 60 is inserted into slot S of tilt drum 10, and the slats 50 are shown at different degrees of closure with the counterclockwise rotation of the tilt drum. It should be again noted that this particular adjustment may also be rotated in a clockwise rotation as well. Within FIG. 8*a*, the polygonal tilt drum 10 is positioned at a 0° angle, and the slats 50 are positioned in parallel relation. As shown in FIG. 8*b* the tilt drum 10 is rotated at a 90° angle and the slats 50 are approximately tilted at a 60° angle. In FIG. 8*c* the tilt drum 10 is rotated at a 180° angle and the slats 50 are shown in a closed relation. The tight closure of the slats is achieved because the ladder tape 60 is not substantively altering the outside diameter of the tilt drum, and the rotational positioning of the retained loops 61*a* and 61*b* within slot S allows the ladder tape 60 to completely extend from the tilt mechanism.

Figure 9A:
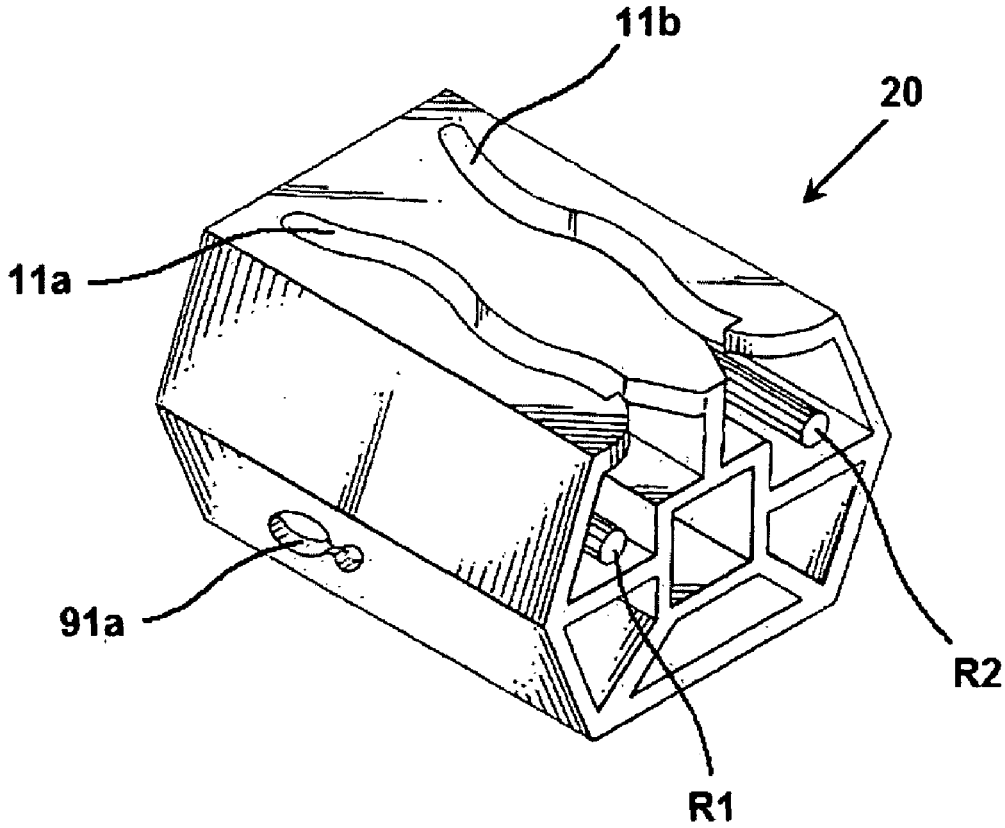
FIGS. 9*a* and 9*b* are perspective views of the alternate embodiments of the instant invention.
Figure 9B:
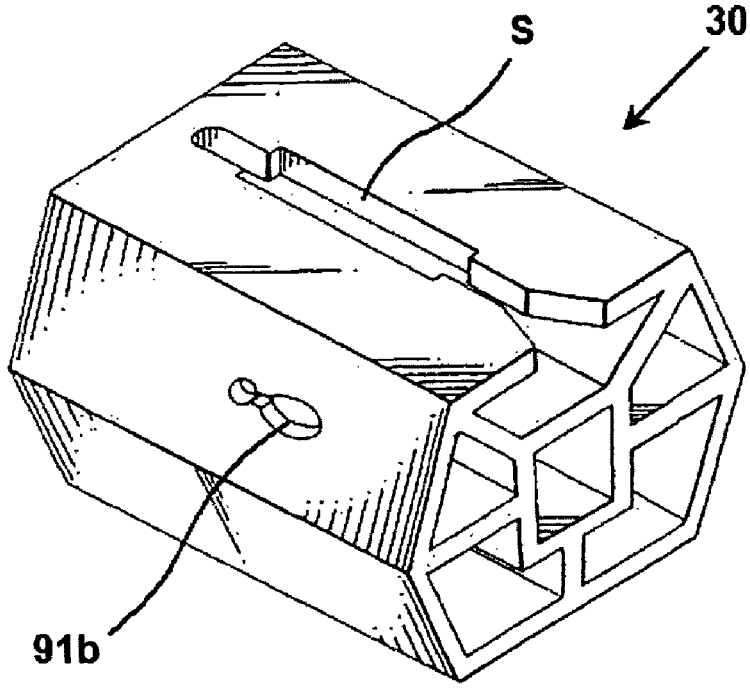

Without departing from the scope of the invention, and as seen in FIGS. 9*a* and 9*b*, the polygonal tilt drum may accommodate the attachment of both ladder cords or tape ladders without having access slots or grooves formed into every planar sidewall of the profile structure. For example, in FIG. 9*a*, ladder tapes may be retained into position by sinusoidal grooves 11*a* and 11*b*, with looped portions being attached to elongated rods R1 and R2. Alternatively, the tabbed ends of ladder cords may be selected and inserted into the mediate ovular slots, yet the option of attaching narrower ladder tapes is not available since a tapered access slot is not formed into the bottom sidewall of tilt drum 20. Then again, in FIG. 9*b*, the elongated rods and sinusoidal grooves are not present in the top sidewall of tilt drum 30, yet narrower ladder tapes may be assembled and inserted in tapered slot S, and the ladder cords may also be retained by the ovular openings located in the mediate sidewalls of the profile structure.

Even though numerous characteristics and advantages of the present invention have been set forth in the foregoing description, together with details of the structure and function of the preferred embodiments, the above disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A ladder drum, which pivotally mounts to a control rod within a Venetian blind tilt mechanism, for selectively regulating the angular adjustment and closure of slats in a horizontal blind assembly of the type incorporating ladder cords and tape ladders, said ladder drum comprising:

an elongated polygonal cylindrical structure having a plurality of exterior plane sidewalls defining a substantially hollow interior;

said exterior plane sidewalls having at least two opposing walls that are equal in dimension but greater in measurement than the remaining mediate sidewalls that define the profile structure;

a tilt rod aperture longitudinally extending through the central section of the polygonal cylindrical structure;

said aperture formed to correspondingly receive a polygonal control rod of the Venetian blind tilt mechanism;

a hollow profile segmented by at least five primary reinforcing ribs which diverge from the central tilt rod aperture defining a sequence of longitudinally extending hollow cavities, with at least two cavities having an open end and a closed end, with said ribs demarcating no less than two upper cavities, two mediate cavities, and one bottom cavity within the profile structure;

a pair of access slots reciprocally located on nonadjacent mediate sidewalls of the profile body to accommodate the insertion and retention of corresponding tabbed ladder legs of a ladder cord;

a single tapered notch, transforming into a wider retaining slot, longitudinally being defined within the bottom cavity of the profile structure;

said wider retaining slot bisecting at least one of the two opposing larger sidewalls of the polygonal tilt drum and the single tapered notch having a midsection that is greater in width than origin or terminus of the wider retaining slot.

2. The ladder drum of claim 1, wherein the number of plane sidewalls defining the polygonal structure are greater than four sidewalls, and less than or equal to twelve sidewalls.

3. The ladder drum of claim 2, wherein the internal angular orientation of each adjacent plane sidewall is in the range of 90° to 150°.

4. The ladder drum of claim 2, wherein the number of plane sidewalls is preferably six sidewalls, forming an uneven hexagonal profile.

5. The ladder drum of claim 1, wherein the pair of reciprocally located access slots consist of a series of two intersecting ovular holes, the first opening greater in proportion than the second.

6. The ladder drum of claim 1, wherein the wider retaining slot is of sufficient dimension to secure the looped end portions of at least two corresponding ladder tape legs.

7. The ladder drum of claim 6, wherein the ladder tape legs are mutually joined through looped end portions with a fastener, said fastener having at least one looped end with at least two opposing retaining prongs that insert into the corresponding looped end portions of the ladder tape legs.

8. The ladder drum of claim 7, wherein the mutually joined ladder tape legs and fastener are inserted and centered into the wider retaining slot of the ladder drum.

9. The ladder drum of claim 1, wherein the ladder drum is molded as one piece.

10. The ladder drum of claim 9, wherein the ladder drum is plastic.

* * * * *